United States Patent [19]

Koshishiba et al.

[11] 4,281,499

[45] Aug. 4, 1981

[54] BOX PACKING MACHINE AND PROCESS

[75] Inventors: Soichi Koshishiba, Kanazawa; Gosei Okazaki, Komatsu, both of Japan

[73] Assignee: Shibuya Kogyo Co., Ltd., Japan

[21] Appl. No.: 43,723

[22] Filed: May 30, 1979

[51] Int. Cl.[3] ..... B65B 35/50; B65B 61/20

[52] U.S. Cl. ..... 53/445; 53/157; 53/238; 53/253; 53/447; 53/474; 53/535; 53/540

[58] Field of Search ..... 53/445, 447, 474, 475, 53/535, 540, 544, 156, 157, 238, 245, 252, 253; 198/408

[56] References Cited

U.S. PATENT DOCUMENTS

| | | | |
|---|---|---|---|
| 2,683,557 | 7/1954 | Jenney | 53/157 X |
| 2,891,361 | 6/1959 | Walter | 53/157 X |
| 3,067,554 | 12/1962 | DeBack | 53/157 |
| 3,854,270 | 12/1974 | Cloud et al. | 53/252 X |
| 3,859,772 | 1/1975 | Thierion | 53/544 X |
| 4,059,264 | 11/1977 | Vogel | 53/157 X |

FOREIGN PATENT DOCUMENTS

| | | | |
|---|---|---|---|
| 261300 | 3/1963 | Australia | 198/408 |
| 521219 | 10/1976 | U.S.S.R. | 198/408 |

*Primary Examiner*—John Sipos

*Attorney, Agent, or Firm*—Fidelman, Wolffe & Waldron

[57] ABSTRACT

A box packing machine and process for packing a shipping box such as a carton with a group of containers such as bottles and cans smoothly without interference between separators and containers. Separators are placed at predetermined positions inside an intermediate box, and a group of containers transported in a matrix form with certain raws and columns and lying on a conveyor are loaded into the intermediate box. Then the containers and separators thus loaded in the intermediate box are transferred into a shipping box such as a carton as a unit and without changing their relative positional relationship. Containers are originally transported upright and in a single line, and they are laid down onto another conveyor every predetermined number whereby containers being laid down are supported on both sides.

26 Claims, 12 Drawing Figures

BOX PACKING MACHINE AND PROCESS

BACKGROUND OF THE INVENTION

The present invention relates to a machine and process for packing a shipping box such as a carton with containers such as bottles and cans which have gone through the steps of filling, capping, labeling, etc. More in particular, the present invention relates to a box packing machine and process which will allow a smooth packing operation without occurrence of the interference between separators and containers.

In the case of loading containers such as bottles and cans which have gone through the steps of filling, capping, labeling, etc. into a shipping box, it has been well known to use separators to prevent the containers from rubbing each other and from becoming disorderly during shipment. There are basically two kinds of separators; that is, a plate type separator and a lattice type separator which is formed by assembling several plate type separators. Such separators are usually made of a relatively soft material such as paper. Depending on the nature and the shape of containers, selection between the two kinds of separators is made.

In a sense, plate type separators are preferable because they do not occupy much space in a shipping box. For example, if the containers are made of an elastic material such as plastic and synthetic resin, like shampoo containers, plate type separators are almost exclusively used. This is because, in such a case, contact between the containers is not a big problem, but the important point is to prevent the containers stored in a shipping box from becoming disorderly during shipment. However, difficulty resides in how to insert plate type separators and containers in a box most efficiently.

Conventionally, plate type separators were inserted after placing a predetermined number of containers in a box. The containers in this case must be properly spaced apart. Otherwise, the separators would interfere with the containers, which would result in the breakage of separators and box, or possibly containers themselves. Therefore, the conventional techniques employing plate type separators are disadvantageous and not suitable for practical use because of its extremely low operation efficiency.

SUMMARY OF THE INVENTION

It is an object of this invention to provide an improved box packing process and machine which are free of interference between containers and separators when containers are packed into a box for shipment.

Another object of this invention is to improve the box packing operation by employing an intermediate box, into which separators and containers are sequentially inserted and then from which they are transferred into a box without changing their positional relationship.

A further object of this invention is to improve the box packing operation by providing an intermediate box which is equipped to hold separators at predetermined positions thereby avoiding interference with containers.

A still further object of this invention is to improve the box packing operation by forming a group of containers arranged in a matrix form with certain raws and columns before being loaded into an intermediate box.

A still further object of this invention resides in the improvements in which containers being transported upright and in a single line are laid down sideways every predetermined number.

A still further object of this invention is to improve each step of the box packing operation to increase the overall operation efficiency.

Other objects, features, and advantages of the present invention will become apparent after a reading of the remainder of this specification and the attached drawings.

DESCRIPTION OF THE PREFERRED EMBODIMENTS

Figure 1:
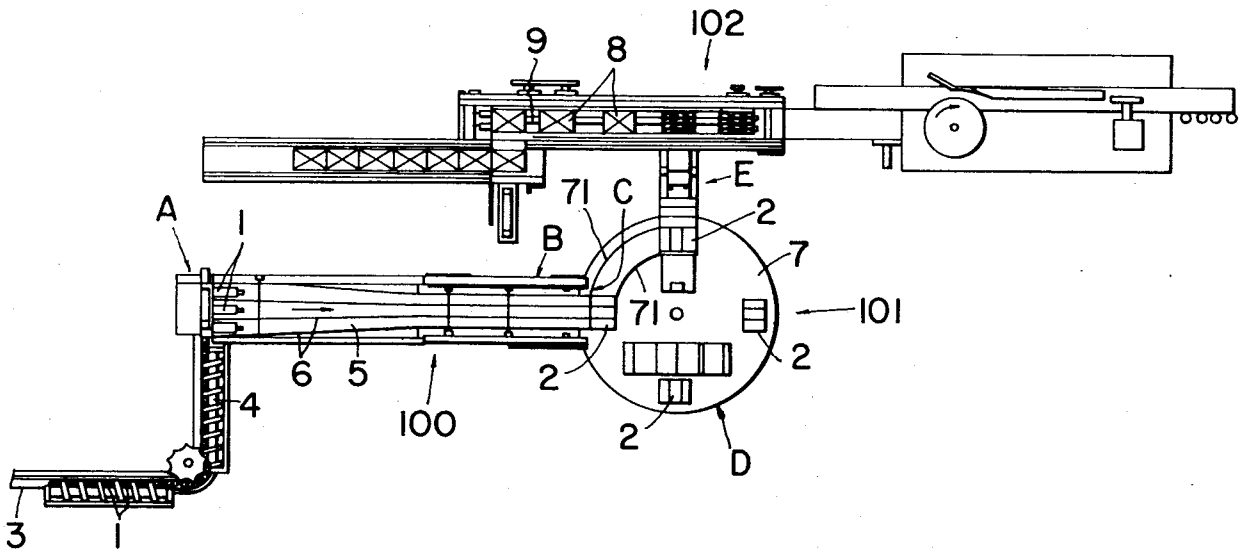
FIG. 1 is a plan view schematically showing the overall structure of the present invention generally comprising a container laying station, a grouping station, an intermediate box loading station, a separator inserting station, and a transferring station.

Referring to FIG. 1, a box packing system in accordance with the present invention generally comprises a container supply section 100, a temporary loading section 101 and a final loading section 102. In the container supply section 100, containers 1 being transported in an upright single column state after passing through the steps of filling, capping, labeling, etc. are rearranged into multi-columns with their side faces down to form a group of containers. The temporary loading section 101 includes an intermediate box into which separators are first inserted to be held at the predetermined positions and then the grouped containers are inserted. At the final loading section 102, the containers and separators thus stored in the intermediate box are transferred into a shipping box such as a carton in unison without changing their positional relationship.

In the container supply section 100, containers 1 are transported in a single line and in an upright condition as riding on a belt conveyor 3, and they are brought into contact with a timing screw 4 which is generally in the form of an auger screw. The timing screw 4 has a predetermined screw pitch to set the containers 1 spaced apart at a predetermined distance. A container laying station A is disposed at the forward end of the timing screw 4. The container laying station A is driven in association with the rotation of the timing screw 4, and, in the embodiment shown in FIG. 1, every three of the upright containers 1 are laid down onto a conveyor 5.

Along the belt conveyor 5 are disposed guide plates 6, which control the direction of transportation of the containers 1 by contacting with the sides thereof. The first half of the guide plates 6 is arranged to form a convergent passage; whereas, the second half of the guide plates 6 is arranged to present a straight passage thereby the spacing between the containers 1 arranged in three lines is set to a predetermined value suitable for loading the containers 1 into an intermediate box 2. In the downstream portion of the second half of the guide plates 6 is provided a grouping station B, where the containers 1 being transported in three lines are formed into a group consisting of twelve containers arranged in a matrix form with four raws and three columns, or lines. An intermediate box loading station C is disposed in the vicinity of the downstream end of the belt conveyor 5, where all the containers 1 thus grouped are loaded into the intermediate box 2.

In the temporary loading section 101, intermediate boxes 2 are mounted vertically movably on a disk 7 which is driven to rotate intermittently. In the embodiment shown in FIG. 1, the disk 7 is driven to rotate in the clockwise direction. Separators are inserted into the intermediate box 2 and held at the predetermined positions therein at a separator inserting station D. Then the disk 7 is driven to rotate by 90 degrees to bring the intermediate box 2 thus inserted with separators to the intermediate box loading station C where a group of twelve containers 1 are loaded into the intermediate box 2 by stacking one after another. During this process, since the separators are held at the predetermined positions in the intermediate box 2, the containers 1 will not interfere with them.

Upon completion of loading the containers 1 into the intermediate box 2, the disk 7 is further driven to rotate by 90 degrees to bring the thus loaded intermediate box 2 to a transferring station E. While, although FIG. 1 shows only one unit at each station of the present box packing system, more than one unit can be conveniently provided to increase the efficiency of box packing operation.

The final loading section 102 comprises a transporting mechanism 9 which transports shipping boxes 8 intermittently. The boxes 8 while being transported by the transporting mechanism 9 are brought one by one to the transferring station E where the containers 1 and separators temporarily stored in the intermediate box 2 in an orderly state are transferred into the box 8 in unison. The box 8 thus loaded at the transferring station E is returned to the transporting mechanism 9 and sent out of the system.

Now referring to FIGS. 2 to 12, explanation will be had with respect to the detailed structure of each station in the present box packing system.

Figure 2:
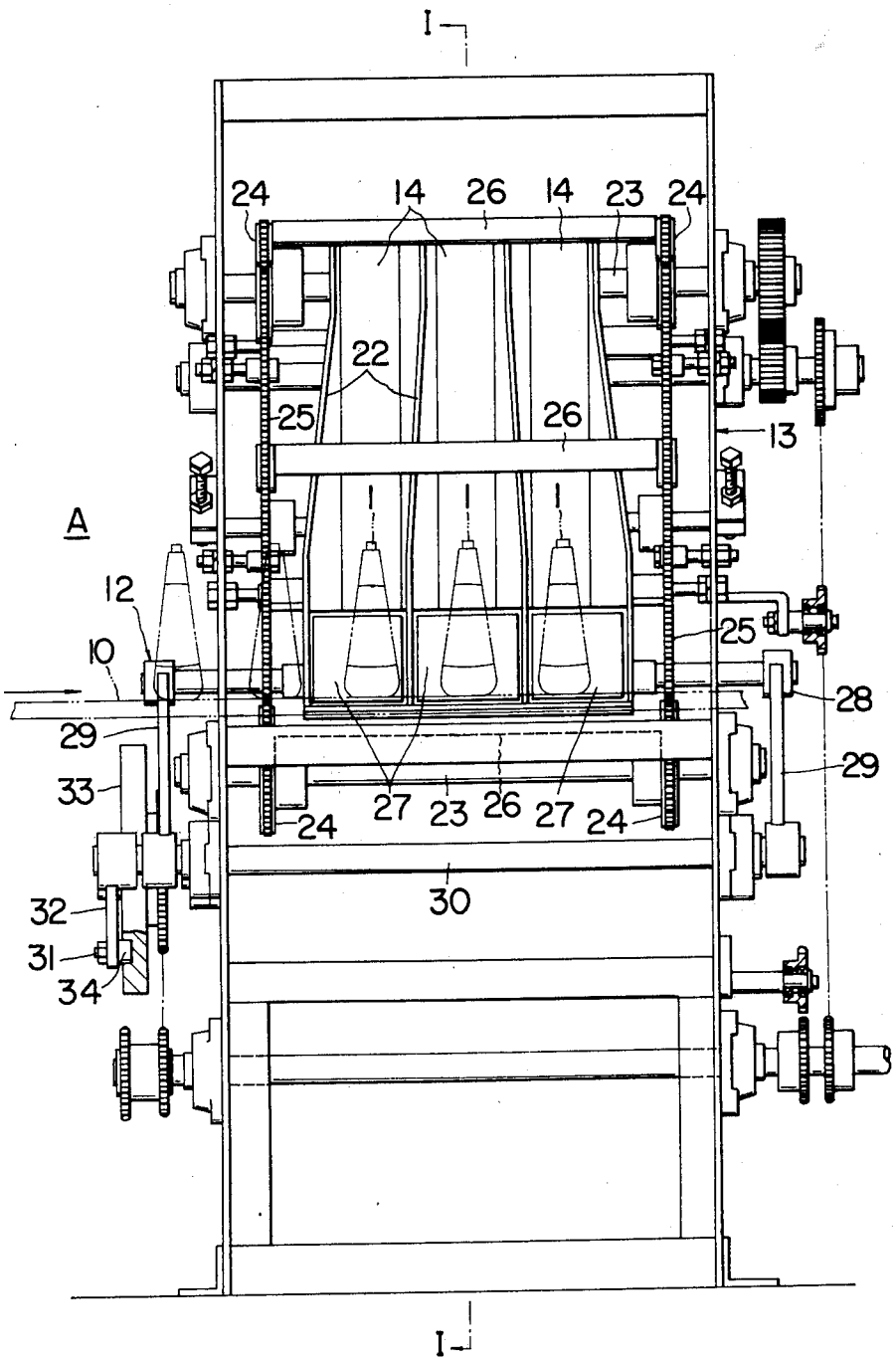
FIG. 2 is a front view of the container laying station.
Figure 3:
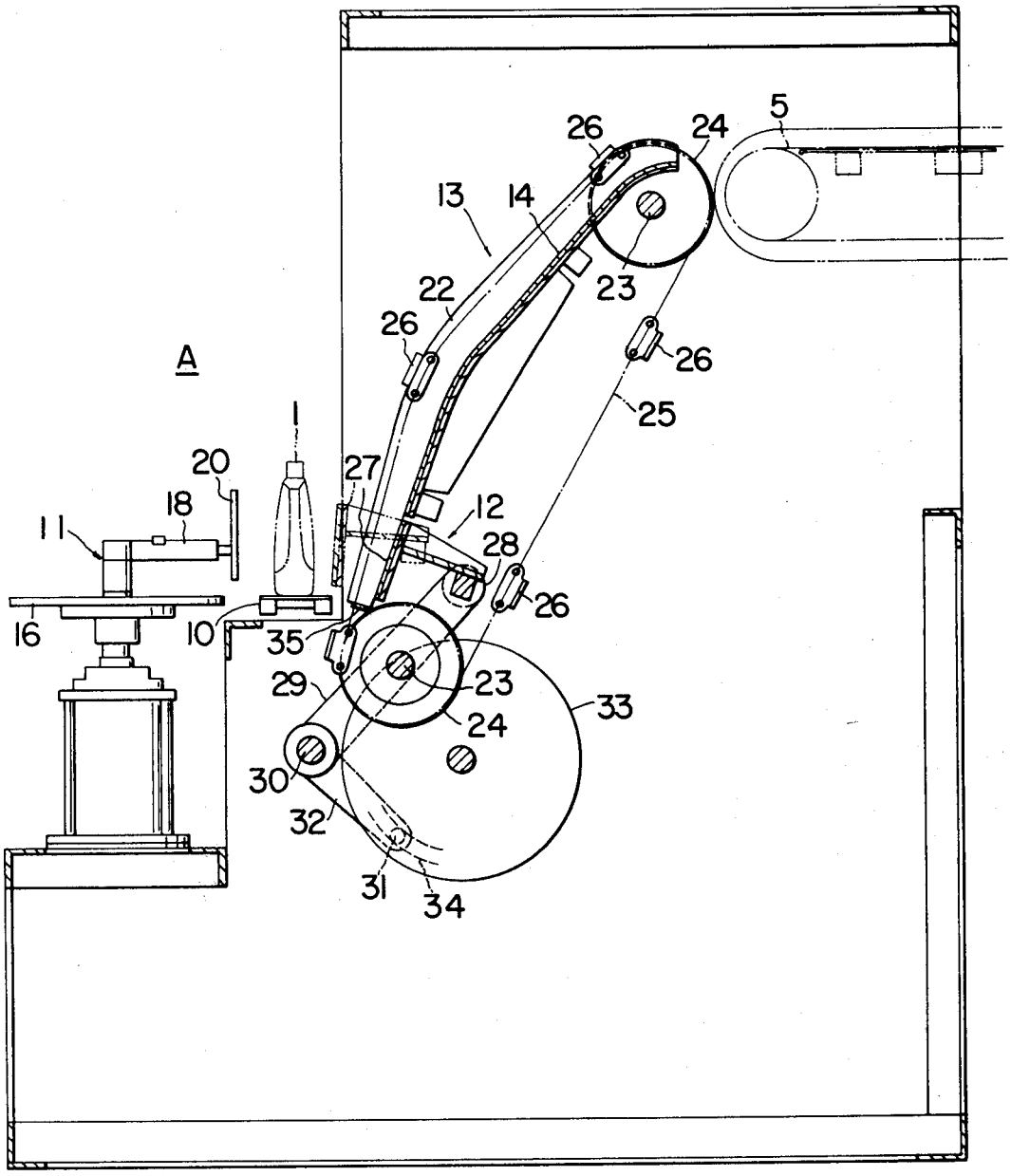
FIG. 3 is a sectional view taken along I—I line of FIG. 2.

At the container laying station A, as shown in FIGS. 2 and 3, the containers 1 spaced apart each other at a predetermined distance by the timing screw 4 are transported, standing on a belt conveyor 10 upright and in a single line, to a predetermined position where every predetermined number of containers 1 (three containers in the embodiment shown in FIGS. 2 and 3) are laid down simultaneously to establish a multi-line transporting condition. As best shown in FIG. 3, the container laying station A comprises, in general, a container pushing mechanism 11, a container receiving mechanism 12, and a container delivering mechanism 13. When three containers 1, which being transported as standing upright on the belt conveyor 10 with a predetermined distance spaced apart each other and in a single line, arrive at a predetermined position defined in the container laying station A, they are turned over until they lie on a floor plate 14 of the container delivering mechanism 12 owing to the cooperation between the container pushing mechanism 11 and the container receiving mechanism 12. In this manner, the containers 1 are converted from an upright transporting condition to a laid down transporting condition.

Figure 4:
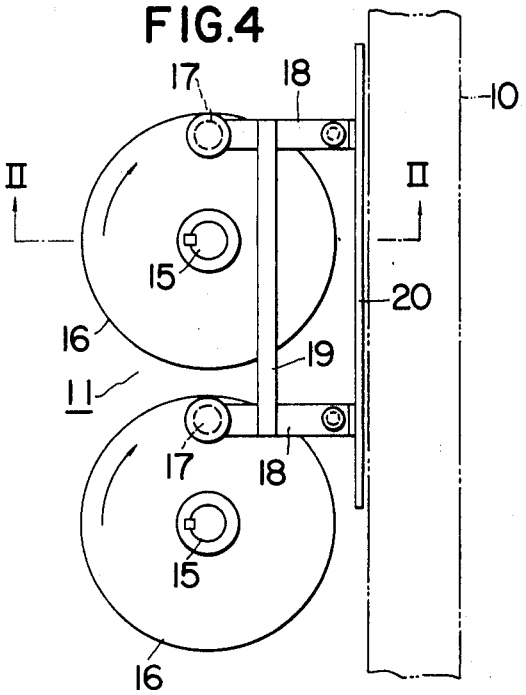
FIG. 4 is a plan view showing in detail the container pushing mechanism of the container laying station.
Figure 5:
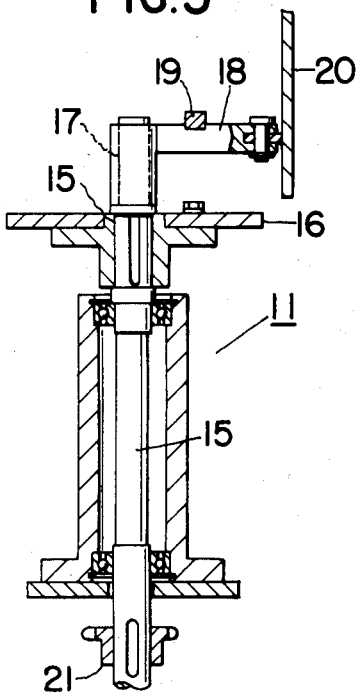
FIG. 5 is a sectional view taken along II—II line of FIG. 4.

FIGS. 4 and 5 depict the detailed structure of the container pushing mechanism 11. The mechanism 11 comprises a pair of shafts 15 rotatably mounted on the housing of the container laying station A, a pair of disk plates 16 individually fixed to the shafts 15, a pair of pins 17 individually planted close to the periphery of the disk plates 16, a pair of arms 18 having one end rotatably connected to the pins 17, a connection bar 19 for keeping the pair of arms 18 in parallel, and a push plate 20 supported by the arms 18 in parallel with the transporting direction of the belt conveyor 10. The push plate 20 must be long enough so that it can push three containers standing on the conveyor 10 simultaneously.

The shafts 15 are driven to rotate in the same direction and with the same speed by a driving source (not shown) through gears 21 fixedly mounted on the shafts 15. This causes the push plate 20 to execute a circular motion without changing the parallel relationship with the transportation direction of the conveyor 10. Thus, if there are containers 1 on the conveyor 10, they are pushed across the conveyor 10 by the push plate 20. Although the push plate 20 moves in a circle, containers 1 can be pushed across the conveyor 10 virtually perpendicular to the transporting direction thereof by choosing an appropriate relative positional relationship between the push plate 20 and the conveyor 10. It goes without saying that the rotational speed of the shafts 15 must be determined in relation to the transporting speed of the conveyor 10.

Explanation will now be given with respect to the container delivering mechanism 13, which delivers the containers 1 thus laid down to the horizontally disposed belt conveyor 5 as shown in FIG. 3. The container delivering mechanism 13 is located on the other side of the conveyor 10 as compared with the container pushing mechanism 13. The container delivering mechanism 13 is provided with guide passages for individually delivering containers 1, which are defined by the floor plate 14 and side plates 22. In order to securely place the containers 1 pushed by the push plate 20 into the guide passages, the bottom portions are somewhat widened as shown in FIG. 2.

The container delivering mechanism 13 further comprises a horizontally disposed pair of shafts 23, a pair of sprockets 24 fixedly provided on both ends of each of the shafts 23, a pair of chains 25 each of which is extended between the two sprockets 24, and a plurality of engaging members 26 fixedly provided by extending between the pair of chains 25 for moving the containers 1 along the floor plate 14 by engaging with their bottoms. In association with the drivement of the container pushing mechanism 11, the shafts 23 are driven to rotate to slide the engaging members 26 along the top ends of the side plates 22 through the sprockets 24 and the chains 25. Accordingly, when the containers 1, with being pushed across the conveyor 10, lie down on the floor plate 14, the engaging members 26 come into engagement with the bottoms of the containers to start to move them along the guide passages to eventually send out to the horizontal conveyor 5. In this instance, since the containers 1 are lying on the floor plate 14, they are transported along the guide passages by sliding on the floor plate 14. As a result, when the containers 1 are sent to the horizontal conveyor 5, they still maintain the lying down posture arranged in three lines.

The container receiving mechanism 12 will now be explained in detail. When the containers 1 are pushed across the conveyor 10 to be laid down on the floor plate 14, there exists some uncertainty mainly due to the frictional force working between containers 1 and the conveyor 10. The container receiving mechanism 12 is provided to securely lay the containers 1 down onto the floor plate 14. The container receiving mechanism 12, as shown in FIG. 3, comprises container receiving members 27, one for each guide passage, which can reciprocate between the retracted position, where the container receiving members 27 are substantially flush with the floor plate, and the advanced position where the container receiving members 27 are close to the containers 1.

The container receiving members 27 are fixedly mounted on a horizontal member 28 which is connected to arms 29. The arms 29 are fixed to a shaft 30 which is rotatably supported by the housing. On the shaft 30 is also fixedly mounted a lever 32 which has a cam follower 31 at its forward end. The cam follower 31, on the other hand, is engaged in a cam groove 34 engraved on the surface of a disk plate 33 rotatably supported by the housing. This disk plate 33 is driven to rotate by a driving source (not shown) in association with the drivement of the container pushing mechanism 11 and the container delivering mechanism 13.

As mentioned before, when three containers 1 come to a predetermined position as transported by the conveyor 10, they are pushed across the conveyor 10 simultaneously. On this occasion, the container receiving members 27 are located at the advanced position to receive the containers 1 with the containers 1 being pushed by the push plate 20. Thus, the containers 1 are held between the push plate 1 and the container receiving members 27 before being laid down onto the floor plate 14. When the container receiving members 27 move back toward the retracted position to be out of the way of the engaging members 26, one of the engaging members 26 comes into contact with the bottoms of the containers 1 thus laid down to deliver them along the guide passages toward the horizontal conveyor 5. Instead of having the engaging member 26 directly contacting the bottoms of the containers 1, the containers 1 can be temporarily rested upon an end plate 35 which is disposed in the vicinity of the bottom end of the container receiving member 27 as shown in FIG. 3. In this alternative, when the containers 1 are laid down on the floor plate 14, they rest on the end plate 35 with their bottoms partially in engagement therewith. Then, one of the engaging members 26 comes into contact with the bottoms of the containers 1 to start to move along the floor plate 14.

Figure 6:
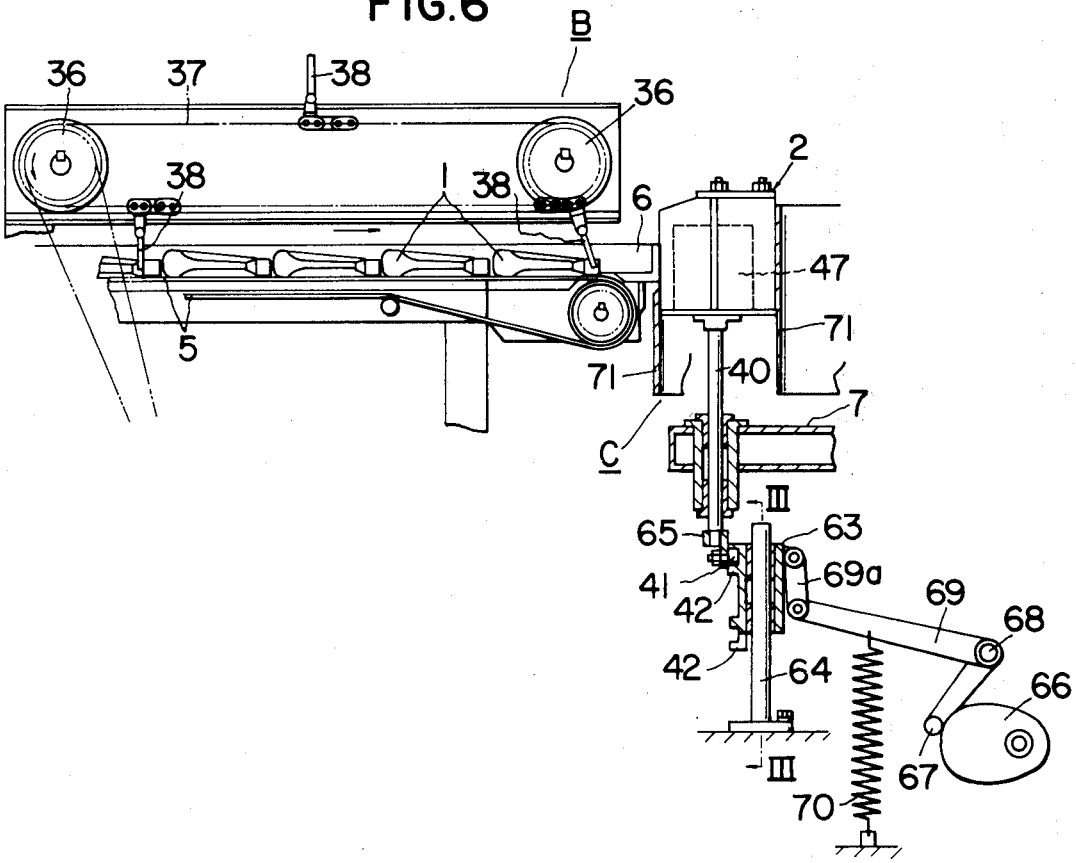
FIG. 6 is a side sectional partial view schematically showing the grouping and intermediate box loading stations.

As shown in FIG. 6, the grouping station B comprises a pair of chains 37 individually extended between a pair of sprockets 36, which are disposed near the downstream end of the conveyor 5, and a plurality of control members 38 mounted on the chains 37 spaced apart each other at a predetermined distance. The control members 38 project substantially perpendicularly to the chains 37, and they are long enough to engage with the containers 1 lying on the conveyor 5. The distance between the neighboring control members 38 in the present embodiment is set so that four containers 1 arranged in a line with head to bottom relationship can be accommodated between the two neighboring control members 38. However, since there are three containers 1 arranged side by side, there are twelve containers 1 in total to form a group. All of the twelve containers 1 in this one group are going to be loaded into the intermediate box 2 and eventually to a shipping box 8 such as a carton.

The chains 37 are driven in the direction as shown with the arrow in FIG. 6 continuously at a low speed or intermittently in association with the motion of the intermediate boxes 2 which are individually and intermittently located at the intermediate box loading station C disposed in the vicinity of the downstream end of the conveyor 5. When containers 1 transported in three lines as lying on the conveyor 5 come into engagement with one of the control members 38 which are moving at a slower speed than the conveyor 5 or temporarily stationary, the following containers 1 come to contact each other with head to bottom relationship and their movements are restrained to cause slippage on the conveyor 5. When four containers 1 in each of the three lines are arranged in a head to bottom contact relationship to form one group, the next following control member 38 comes around the sprockets 36 to engage with the next following containers 1 to start to form another group. On the other hand, when the next following control member 38 comes around to engage with the next following containers 1, the preceding control member 38 moves around the other sprocket 36 to release the restraint of all of the twelve containers 1. As a result, these twelve containers 1 thus relieved of the constraint start to move, lying on the conveyor 5, faster than those in the next group, which are under the restraint of the next following control member 38. Then, these freed twelve containers 1 are loaded by stacking one another in each line into the intermediate box 2 which is located at the intermediate box loading station C.

Figure 8:
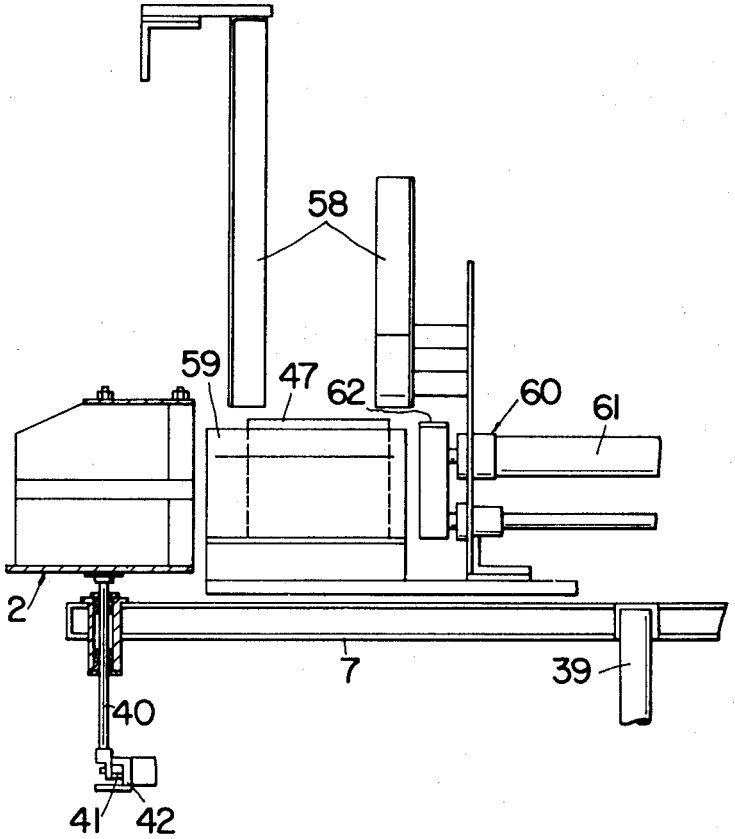
FIG. 8 is a partially sectional side view showing the state where separators are inserted into the intermediate box.

Now, explanation will be had with respect to the structure and the operating mechanism of the intermediate box 2. Referring to FIG. 8, the disk 7 is fixedly supported at its center by a shaft 39 which is driven to rotate intermittently every 90 degrees by a driving source (not shown). Four support rods 40 are arranged radially symmetrically and they are so mounted in the vicinity of the periphery of the disk 7 that they can slide vertically in a regulated fashion. An intermediate box 2 is securely mounted at the top end of each of the support rod 40, the bottom end of which is provided with a roller 41 which is in engagement with a cam 42 disposed below the disk 7 and substantially along its periphery. By driving the shaft 39 to rotate the disk 7 intermittently, the support rod 40 and hence the intermediate box 2 move up and down with respect to the disk 7 as guided by the cam 42.

Figure 10A:
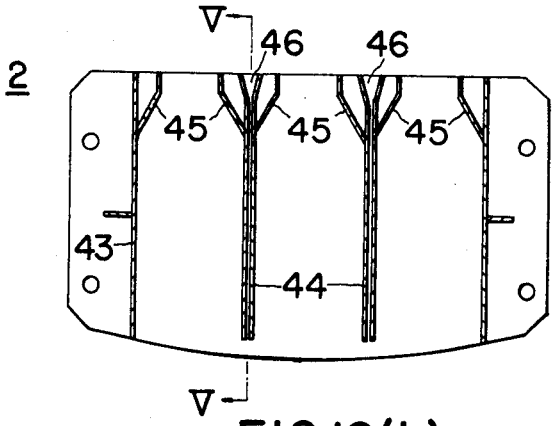
FIG. 10 shows the structure of the intermediate box, in which (b) is a front view of the intermediate box, (a) is a sectional view taken along IV—IV line of (b) and (c) is a sectional view taken along V—V line of (a)
Figure 10B:
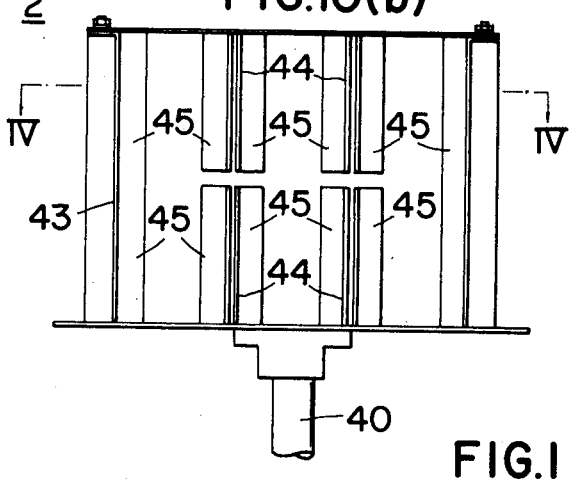
Figure 10C:
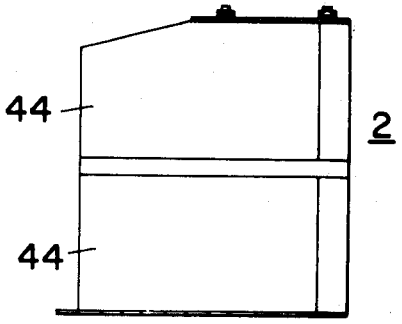

The structure of an intermediate box 2 is shown in detail in FIG. 10. The intermediate box 2 generally comprises a main body 43 in the shape of a box with two opposing faces open, separator holding members 44 provided inside the main body, and container stoppers 45 provided on one side of the main body 43 to be engageable with the shoulder portions of containers 1. The separator holding members 44 are basically made of a pair of plates spaced apart at a predetermined distance to hold a separator loosely therebetween. As shown in FIG. 10, the separator holding members 44 are disconnected at midpoint. The provision of this disconnection allows to transfer in unison the containers and separators loaded in the intermediate box 2 to a shipping box. There is also formed a fan shaped section 46 at one end of each pair of the separator holding members 44 to facilitate the insertion of a separator.

Figure 9:
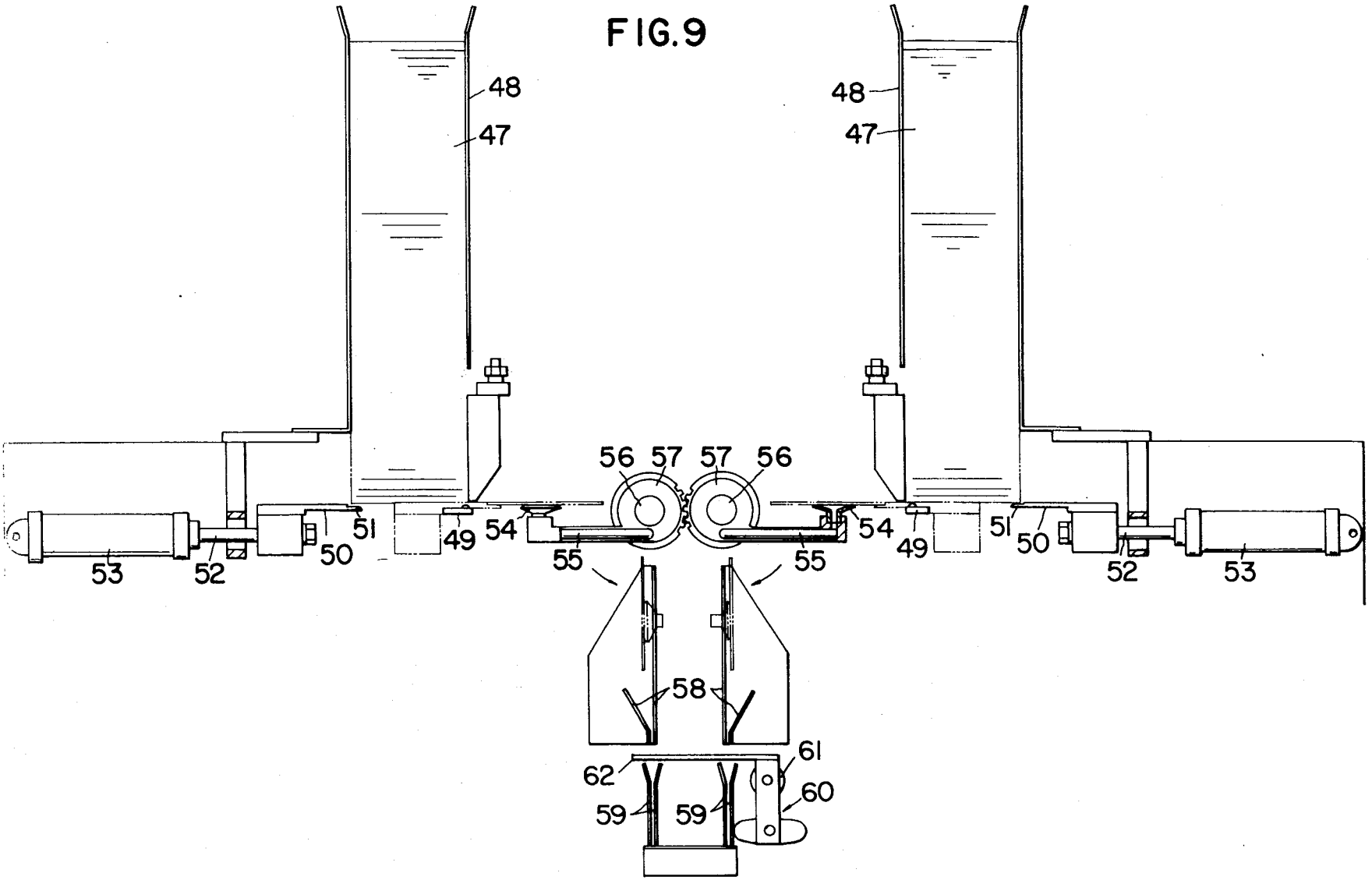
FIG. 9 is a front view of the separator inserting station.

The detailed structure of the separator inserting station D is shown in FIGS. 8 and 9. As shown in FIG. 9, separators 47 are stacked in a pair of separator holders 48. The bottom most sheet of the stack in each holder 48 rests on a detent member 49 and the stepped portion 51 of a send out member 50. The send out member 50 is fixedly mounted on a rod 52, which, in turn, is connected to a piston (not shown) housed in a cylinder 53 reciprocatingly movably as driven by fluid pressures. When the sent out member 50 advances as driven by a fluid pressure control device (not shown), the bottom most separator 47 moves out of the holder 47, since it is engaged with the stepped portion 51 of the send out member 50, to be placed on a suction member 54. Then the send out member 50 is returned to the initial position by means of the before-mentioned fluid pressure control device (not shown) thereby the stepped portion 51 comes to be engaged with one end of the next bottom most separator 47.

While, the suction member 54 is fixedly mounted on one end of an arm 55, the other end of which is fixedly connected to a disk 57 which, in turn, is fixed to a shaft 56. The suction member 54 can be fluid dynamically connected to a negative pressure source (not shown) partly through the arm 55. In association with the movement of the send out member 50, the negative pressure source is operatively connected to the suction member 54 to hold the separator 47 thereon by suction. Then the shaft 56 is rotated in the direction shown with the arrow in FIG. 9 by a predetermined angle (90 degrees in the present embodiment) to hold the separator 47 vertically. Under the circumstances, by disconnecting the suction member 54 from the negative pressure source, the separator 47 starts to fall down under gravity and passes through guide plates 58 to be finally held between a pair of vertical holder plates 59 spaced apart at a predetermined distance.

Thereafter a cylinder actuator 61 of a horizontal feed-in mechanism 60 becomes actuated by a fluid pressure control device (not shown) to move a horizontal bar 62 forward. This forward motion of the horizontal bar 62 transfers the two separators individually held by the pair of vertical holder plates 59 into the intermediate box 2. Since each pair of the vertical holder plates 59 is in alignment with the corresponding pair of the separator holding members 44 of the intermediate box 2, the separators 47 fed into the intermediate box 2 are led into the respective separator holding members 44 thereby proper positioning of separators is accomplished.

Figure 7:
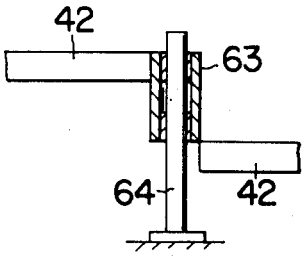
FIG. 7 is a sectional partial view taken along III—III line of FIG. 6 to show the disconnected state of the ring cam.

The intermediate box loading station C comprises, as shown in FIG. 6, a mechanism for lowering the intermediate box 2 in association with the transportation of the containers 1 from the grouping station B. More in detail, there is provided a sliding member 63 slidably mounted on a vertical stationary shaft 64 wherein the sliding member 63 includes a roller receiving portion 65 formed near the top end. As shown in FIG. 7, the ring-shaped cam 42 disposed below the disk 7 is disconnected at the vertical stationary shaft 64 in such a manner that one end is located above the other. Thus, upon reaching the upper end of the cam 42, the roller 41 is accepted in the roller receiving portion 65. Then the roller 41 moves down along the shaft 64 to be finally brought into engagement with the lower end of the cam 42.

Referring again to FIG. 6, there is provided a cam 66 which is driven to rotate in association with the disk 7 and the grouping station B. A roller 67 is mounted on one end of a crank 69 which is pivoted to a shaft 68. A spring 70 is extended between the housing and the crank 69 to keep the roller 67 in resilient contact with the peripheral surface of the cam 66. The other end of the crank 69 is operatively connected to the sliding member 63 through a link 69*a* so that the sliding member 63 moves up and down along the vertical shaft 64 between the upper and lower ends of the cam 42 in association with the rotating motion of the cam 66.

The intermediate box 2 with separators inserted at the separator inserting station D is rotated by 90 degrees around the shaft 39 to be brought to the intermediate box loading station C, and it remains stationary at a predetermined position for a while. At this moment, the roller 41, as guided by the cam 42, enters into the roller receiving portion 65 of the sliding member 63 which is located at the upper position of the shaft 64 as shown in FIGS. 6 and 7. While, the intermediate box 2 is so located at this moment that the bottom surface thereof is slightly below the top surface of the conveyor 5. Under the circumstances, when the intermediate box 2 stops at the predetermined position of the intermediate box loading station C, the control member 38 moves around the sprockets 36 to release the restraint of the grouped twelve containers 1. As a result, the front end container 1 in each of the three lines is fed into the intermediate box 2 as driven by the conveyor 5 to be placed on the bottom surface thereof.

Then the rotation of the cam 66 brings the sliding member 63 downward, and therefore, the intermediate box 2 is lowered to some extent through the cooperation among the roller receiving portion 65, the roller 41 and the support rod 40. As soon as the top side surface of the containers 1 lying on the bottom surface of the intermediate box 2 comes lower than the top surface of the conveyor 5, the next following three containers 1, arranged side by side and spaced apart each other at a predetermined distance, are fed into the intermediate box 2 by being stacked on the containers 1 lying already on the bottom surface thereof. In like manner, the remaining containers 1 of the same group still riding on the conveyor 5 are fed into the intermediate box 2 successively. So, all of the twelve containers 1 belonging to the same group are loaded into the intermediate box 2 in three lines and with being stacked one another in each line.

During this intermediate box loading process, since the separators 47 are held at their proper positions by the respective separator holding members 44, containers 1 are prevented from interfering with the separators 47 when they are fed into the intermediate box 2. Furthermore, as shown in FIGS. 1 and 6, a pair of stationary guides 71 extending between the intermediate box loading station C and the transferring station E in an arc shape are provided. The objective of these stationary guides 71 is to prevent the containers 1 and separators 47 thus loaded in the intermediate box 2 from slipping away from the box 2 while they are moved from the intermediate box loading station C to the transferring station E.

Figure 11:
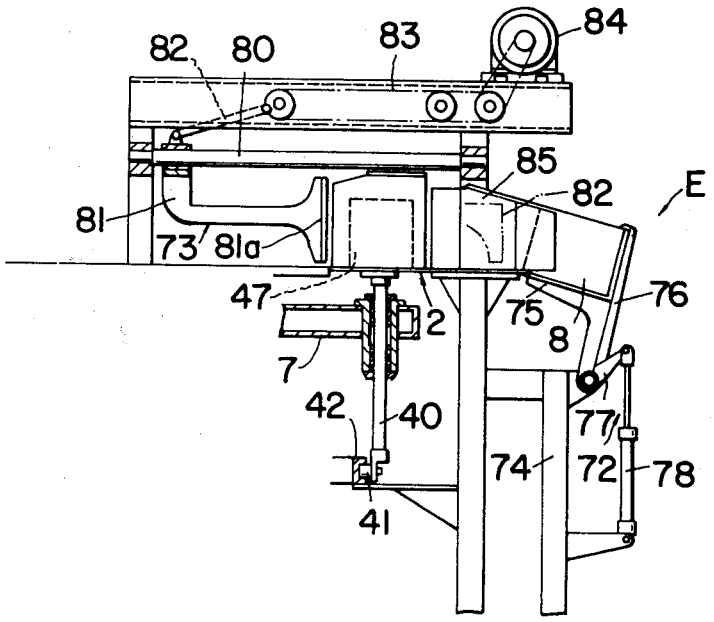
FIG. 11 is a sectional view of the transferring station.
Figure 12:
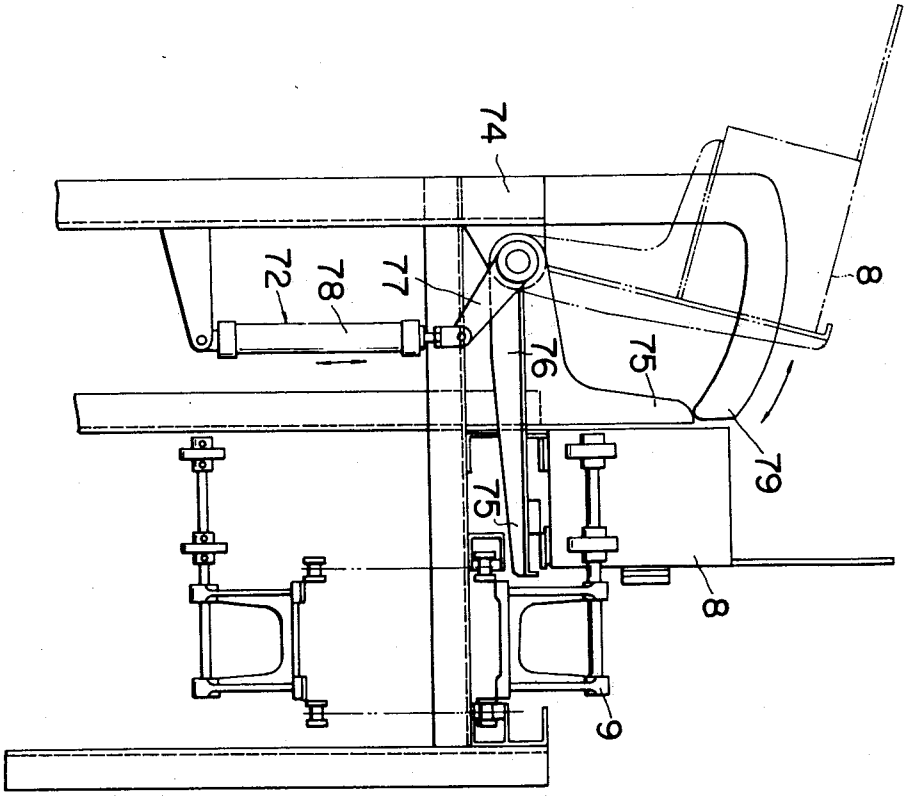
FIG. 12 is an enlarged partial view of the transferring station.

As mentioned above, as soon as the intermediate box 2 is loaded with all of the twelve containers 1 of the same group, it is further rotated by 90 degrees to be brought to the transferring station E. As shown in FIGS. 11 and 12, the transferring station E comprises a swing mechanism 72 which moves a shipping box 8 such as a carton between the transporting mechanism 9 and the position adjacent to the intermediate box 2, and a plunging mechanism 73 which transfers the containers 1 and separators 47 installed in the intermediate box 2 into the shipping box 8 as a unit. The swing mechanism 72 includes a swing member 76, one end thereof being pivoted to the housing 74. The swing member 76 is provided with support members 75 to support the shipping box 8 by contacting with its bottom and side surfaces during the swinging motion. An arm 77 is integrally provided with the swing member 76 and is operatively connected to a cylinder actuator 78, which drives to swing the swing member 76 approximately over 90 degrees. Moreover, along the swing path of a shipping box 8 is disposed a stationary guide plate 79 to guide the swing motion of a shipping box 8.

The plunging mechanism 73 comprises a plunging member 81 which is slidably carried by a guide rail 80 which extends in the radial direction of the disk 7. The plunging member 81 has a plunging front surface 81*a* which is so formed that it does not interfere with the separator holding members 44 of the intermediate box 2, but it can contact all of the twelve containers 1 and the two separators 47 installed in the intermediate box 2 to push forward as a unit. On the other hand, the plunging member 81 is operatively connected to a chain 83 extended in parallel with the guide rail 80 through a lever 82. The chain 83 is driven by a motor 84 to move the plunging member 81 with respect to the intermediate box 2 in association with the drivement of the shaft 39 which rotates the disk 7.

When a shipping box 8, intermittently transported by the transporting mechanism 9, comes to be located at the support members 75 of the swing member 76, the cylinder actuator 78 is energized to swing the swing member 76 approximately over 90 degrees. Because of this, the shipping box 8 now supported by the support members 75 is brought to the position adjacent to one open side of the intermediate box 2. In this instance, since the shipping box 8 is rotated about 90 degrees, the top opening thereof faces the open side of the intermediate box 2.

In this situation, the intermediate box 2 loaded with the containers 1 and separators 47 enters into the transferring station E and, as soon as it stops at a predetermined position, the plunging member 81 is driven to move forward, through a driving train consisting of motor 84, chain 83 and lever 82, along the guide rail 80 thereby the plunging front surface 81*a* eventually comes into contact with all of the containers 1 and separators 47 stored in the intermediate box 2. Further forward movement of the plunging member 81 causes to move all of the containers 1 and separators 47 stored in the intermediate box 2 without changing their positional relationship. Finally, the containers 1 and separators 47 are moved out of the intermediate box 2, and they are transferred into the shipping box 8 as guided inbetween by side guides 85 fixedly mounted on the housing 74. After transferring the containers 1 and separators 47 into the shipping box 8, the plunging member 81 returns to the original position; whereas, the shipping box 8 thus loaded is swung back to the transporting mechanism 9. Then the disk 7 is rotated by 90 degrees to carry out the next operation. While the shipping box 8 thus loaded and brought back to the transporting mechanism 9 is then transported to a desired location.

Use is made of plate type separators in the above-described embodiment, but this does not exclude the possibility of using lattice type separators. However, in the case of using lattice type separators the separator inserting station D and the separator holding members 44 of an intermediate box 2 must be modified accordingly.

It will be understood that various changes in detail, materials, steps and arrangements of parts, which have been herein described and illustrated in order to explain the nature of the invention, may be made by those skilled in the art within the principle and scope of the invention as expressed in the appended claims. However, while the invention has been described with reference to the structure disclosed herein, it is not to be confined to the details set forth, and this application is intended to cover such modifications or changes as may come within the scope of the following claims.

We claim:

1. A box packing process for packing a box with a group of containers and at least one separator sandwiched between at least two of said containers, comprising a step of inserting at least one separator into a separator holding means mounted in an intermediate box, a step of loading the intermediate box on opposing sides of the separator with containers which are transported in a predetermined number of lines, and a step of transferring the containers and separators thus loaded from the intermediate box into a shipping box as a unit.

2. A box packing process according to claim 1 further comprising a step of changing the container transportation mode from an upright single line mode to a laid down mode with a predetermined number of lines.

3. A box packing process according to claim 2, wherein said step of changing the container transportation mode comprised a step of laying the containers down after supporting the upright containers on two sides.

4. A box packing process according to claim 1 further comprising a step of forming a group of containers, which are transported as being laid down and in a predetermined number of lines, before being loaded into the intermediate box, all of the containers of the same group being loaded into the intermediate box.

5. A box packing process according to claim 4, wherein the intermediate box is lowered in association with the transportation of the containers for loading all of the containers of the same group into the intermediate box.

6. A box packing process according to claim 1, wherein the intermediate box moves along a circle intermittently every predetermined angle and said steps are carried out sequentially during the intermediate box remains stationary.

7. A box packing process according to claim 1, wherein the intermediate box has two open sides opposite each other and at least one separator is inserted into the intermediate box sideways through one of said open sides.

8. A box packing process according to claim 7, said separator is of the plate type.

9. A box packing machine for packing a box with a group of containers and at least one separator sandwiched between at least two of said containers, comprising an intermediate box, separator holding means provided in said intermediate box for holding at least one separator, means for moving said intermediate box, separator inserting means for inserting at least one separator into said separator holding means, intermediate box loading means for loading a predetermined number of containers into the intermediate box on opposing sides of the separator, and transferring means for transferring the containers and separators thus loaded from said intermediate box into a shipping box as a unit.

10. A box packing machine according to claim 9, wherein said means for moving said intermediate box comprises an intermittently rotatable disk on which a plurality of said intermediate boxes are mounted, said intermediate boxes being vertically movable with respect to said disk.

11. A box packing machine according to claim 9 further comprising transporting means for transporting thereon containers in an upright single line, and container laying down means for laying down said containers on said transporting means every predetermined number prior to loading into said intermediate box.

12. A box packing machine according to claim 11, wherein said container laying down means comprises container pushing means for pushing containers on said transporting means every predetermined number thereacross, container receiving means operatively associated with said container pushing means for laying down said containers, and delivering means for delivering the thus laid down containers.

13. A box packing machine according to claim 12, wherein said container pushing means comprises a push plate movable between an advanced position where predetermined number of containers are pushed across said transporting means and a retracted position for allowing containers to be transported by said transporting means, and push plate operating means for operating said push plate in association with said transporting means.

14. A box packing machine according to claim 12, wherein said container receiving means comprises a container receiving member movable between an advanced position close to the containers standing on said transporting means and a retracted position where the containers are laid down, and container receiving member operating means for operating said container receiving member in association with said container pushing means.

15. A box packing machine according to claim 14, wherein said container receiving member is divided so that the containers of a given number are individually supported by said container receiving member during the laying down process.

16. A box packing machine according to claim 14, wherein said delivering means comprises a floor plate, side plates provided on said floor plate to define guide passages, and means for moving the containers lying on said floor plate along said guide passages.

17. A box packing machine according to claim 9, wherein said separator inserting means comprises at least one holder for holding therein a quantity of separators stacked vertically, removing means for removing the bottom most separator out of said holder, holding means for holding the thus removed separator vertically, and means for moving said separator held by said holding means horizontally into said separator holding means of said intermediate box.

18. In a process for packing a box with a group of containers and at least one separator sandwiched between at least two of said containers, including a separator inserting station, a grouping station, an intermediate box loading station, and a transferring station, wherein said process comprises the steps of:

inserting at least one separator into a separator holding means mounted in an intermediate box after locating said intermediate box at said separator inserting station;

moving said intermediate box thus inserted with at least one separator to said intermediate box loading station and then loading said intermediate box on opposing sides of said separator with a predetermined number of containers grouped at said grouping station;

transferring the containers and at least one separator sandwiched between the containers thus loaded from said intermediate box directly into a shipping box after moving said loaded intermediate box along stationary guides to said transferring station; and moving said intermediate box, now empty, to said separator inserting station for a new cycle of packing operation.

19. The process of claim 18 wherein said containers are continuously fed to said grouping station as being laid down.

20. The process of claim 19 wherein said containers are carried on a conveyor belt and the motion of the containers are temporarily restrained in forming a group of containers to be loaded into said intermediate box.

21. The process of claim 20 wherein said containers are flattened bottle-shaped containers such as shampoo containers.

22. The process of claim 18 wherein the loading and unloading of containers into and out of said intermediate box are carried out through the same side of said intermediate box.

23. A box packing machine for packing a box with a predetermined number of containers and at least one separator sandwiched between at least two of said containers, comprising:

a rotatable disk driven to rotate intermittently;

a plurality of intermediate boxes supported on said rotatable disk to be movable in the vertical direction, each of said intermediate boxes including means for holding at least one separator and stoppers engageable with the containers;

means for inserting at least one separator into one of said intermediate boxes so that the separator is held by said separator holding means;

means for forming a group of containers with a given number;

means for loading the thus grouped containers into said intermediate box on opposing sides of said inserted separator;

means for transferring the containers and the separator sandwiched between the containers from said intermediate box into a shipping box; and stationary guides extending between said loading means and transferring means for keeping said containers and separator inside said intermediate box.

24. The machine of claim 23 wherein said group forming means comprises a conveyor belt on which the containers are carried and means for restraining the advancement of the containers for forming a group.

25. The machine of claim 24 wherein said restraining means comprises a chain extended between a pair of sprockets and a plurality of control members, fixedly attached to said chain, spaced apart from one another at a predetermined distance.

26. The machine of claim 25 wherein said chain is driven to advance at a slower speed than said conveyor belt.

* * * * *